US009037050B2

(12) United States Patent
Kato et al.

(10) Patent No.: US 9,037,050 B2
(45) Date of Patent: May 19, 2015

(54) DEVELOPER CONTAINER HAVING A DEVELOPER CONVEYING MEMBER INCLUDING AN URGING MEMBER

(71) Applicants: Shuichi Kato, Nagoya (JP); Yohsuke Hata, Nagoya (JP); Norio Uchida, Nagoya (JP)

(72) Inventors: Shuichi Kato, Nagoya (JP); Yohsuke Hata, Nagoya (JP); Norio Uchida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 13/789,776

(22) Filed: Mar. 8, 2013

(65) Prior Publication Data

US 2013/0259530 A1 Oct. 3, 2013

(30) Foreign Application Priority Data

Mar. 30, 2012 (JP) ..... 2012-078996

(51) Int. Cl.
*G03G 15/08* (2006.01)

(52) U.S. Cl.
CPC ..... *G03G 15/0832* (2013.01); *G03G 15/0889* (2013.01); *G03G 2215/0132* (2013.01); *G03G 2215/0844* (2013.01); *G03G 15/0865* (2013.01); *G03G 15/0877* (2013.01); *G03G 15/0891* (2013.01); *G03G 15/0896* (2013.01)

(58) Field of Classification Search
CPC ..... G03G 15/0822; G03G 2215/0844
USPC ..... 399/254, 258, 262
See application file for complete search history.

(56) References Cited

U.S. PATENT DOCUMENTS

| | | | | |
|---|---|---|---|---|
| 6,047,141 | A * | 4/2000 | Miyaoka et al. | 399/27 |
| 6,289,197 | B1 * | 9/2001 | Matsumoto et al. | 399/281 |
| 6,385,422 | B1 * | 5/2002 | Ishiguro et al. | 399/258 |
| 6,415,126 | B2 * | 7/2002 | Kaneshige et al. | 399/256 |
| 6,456,810 | B1 * | 9/2002 | Deguchi et al. | 399/254 |
| 7,529,508 | B2 * | 5/2009 | Choi et al. | 399/256 |
| 7,558,514 | B2 * | 7/2009 | Yamamura | 399/256 |
| 7,829,840 | B2 * | 11/2010 | Nakajima | 250/254 |
| 7,860,437 | B2 | 12/2010 | Kakuta et al. | |
| 8,036,543 | B2 * | 10/2011 | Yokomori et al. | 399/27 |
| 8,045,898 | B2 * | 10/2011 | Kitaoka | 399/258 |
| 2008/0247784 | A1 | 10/2008 | Kakuta et al. | |

(Continued)

FOREIGN PATENT DOCUMENTS

| | | |
|---|---|---|
| JP | 11-119537 A | 4/1999 |
| JP | 2008-170951 A | 7/2008 |

OTHER PUBLICATIONS

English Machine Translation of Niihara, Takayuki, Toner Residual Amount Detecting Device, Apr. 30, 1999, JPO JP11-119537.*

*Primary Examiner* — Clayton E Laballe
*Assistant Examiner* — Trevor J Bervik
(74) *Attorney, Agent, or Firm* — Banner & Witcoff, Ltd.

(57) ABSTRACT

A developer container for an image forming apparatus includes a housing configured to store developer, a developer conveying member disposed inside the housing and configured to rotate to convey the developer stored in the housing. The developer conveying member includes a rotary shaft, a rotary base member and a sheet-like main body. The main body has a base end portion fixed to the rotary base member and a free end portion configured to be pressed into contact with an inner wall of the housing. The rotary base member includes an urging member configured to urge the main body from an upstream side toward a downstream side in a direction of rotation thereof.

7 Claims, 7 Drawing Sheets

(56) References Cited

U.S. PATENT DOCUMENTS

2009/0297175 A1* 12/2009 Kakuta et al. ..... 399/27
2011/0076062 A1 3/2011 Kakuta et al.
2011/0081169 A1* 4/2011 Ichikawa ..... 399/258
2012/0170955 A1 7/2012 Kakuta et al.

* cited by examiner

DEVELOPER CONTAINER HAVING A DEVELOPER CONVEYING MEMBER INCLUDING AN URGING MEMBER

CROSS-REFERENCE TO RELATED APPLICATION(S)

This application claims priority from Japanese Patent Application No. 2012-078996 filed on Mar. 30, 2012, the disclosure of which is incorporated herein by reference in its entirety.

FIELD

Apparatuses consistent with one or more aspects of the present invention relate to a developer container for an image forming apparatus.

BACKGROUND

A development device provided in an image forming apparatus, such as a laser printer, a digital photocopier, etc., typically comprises a developer container containing developer (toner), and a development chamber into which developer is conveyed from the developer container. In the development chamber, a development roller for carrying developer on its peripheral surface and a supply roller for supplying developer onto the peripheral surface of the development roller are provided.

A developer container included in this type of development device may incorporate an agitator (a developer conveying member) configured to agitate and convey developer into the development chamber. The agitator may be configured to include a rotary base member (conveyance support shaft part) rotatable together with a rotary shaft, and an agitator main body (sheet-like part) having a base end portion fixed to the rotary base member and a free end portion allowed to turn around along an inner wall of the container while the rotary base member rotates. The agitator main body (main body) may be composed of a sheet-like elastic piece which may be curved with the help of its elastic property when it revolves around with its free end portion pressed against and caused to slide along the inner wall of the container in a direction of revolution of the agitator main body.

The developer conveying member provided in the above-described or similar developer container known in the art tends to have its resilience reduced by creep of the main body which is curved during its revolving motion. Accordingly, the amount of developer conveyed by the developer conveyor member gradually decreases. Particularly, in cases where the development chamber is disposed in an upper position of the developer container and the main body conveys developer in an upward direction, the amount of developer to be conveyed into the development chamber could disadvantageously decrease enormously.

Under the circumstances, there is a need of an improved developer container included in a development device for an image forming apparatus, in which a developer conveying member is provided with increased conveying ability and durability.

SUMMARY

It is one aspect to provide a developer container in which the aforementioned need is satisfied.

More specifically, according to one or more embodiments of the present invention, a developer container for an image forming apparatus is provided, which comprises a housing and a developer conveying member. The housing is configured to store developer. The developer conveying member is disposed inside the housing and configured to rotate to convey the developer stored in the housing. The developer conveying member comprises a rotary shaft, a rotary base member configured to rotate together with the rotary shaft, and a sheet-like main body fixed to the rotary base member and configured to revolve around the rotary shaft. The main body has a base end portion fixed to the rotary base member and a free end portion configured to be pressed into contact with an inner wall of the housing. The rotary base member comprises an urging member configured to urge the main body from an upstream side toward a downstream side in a direction of rotation thereof.

BRIEF DESCRIPTION OF THE DRAWINGS

The above aspect, various configurations, their advantages and further features of the present invention will become more apparent by describing in detail illustrative, non-limiting embodiments thereof with reference to the accompanying drawings, in which.

DESCRIPTION OF EMBODIMENTS

Figure 1:
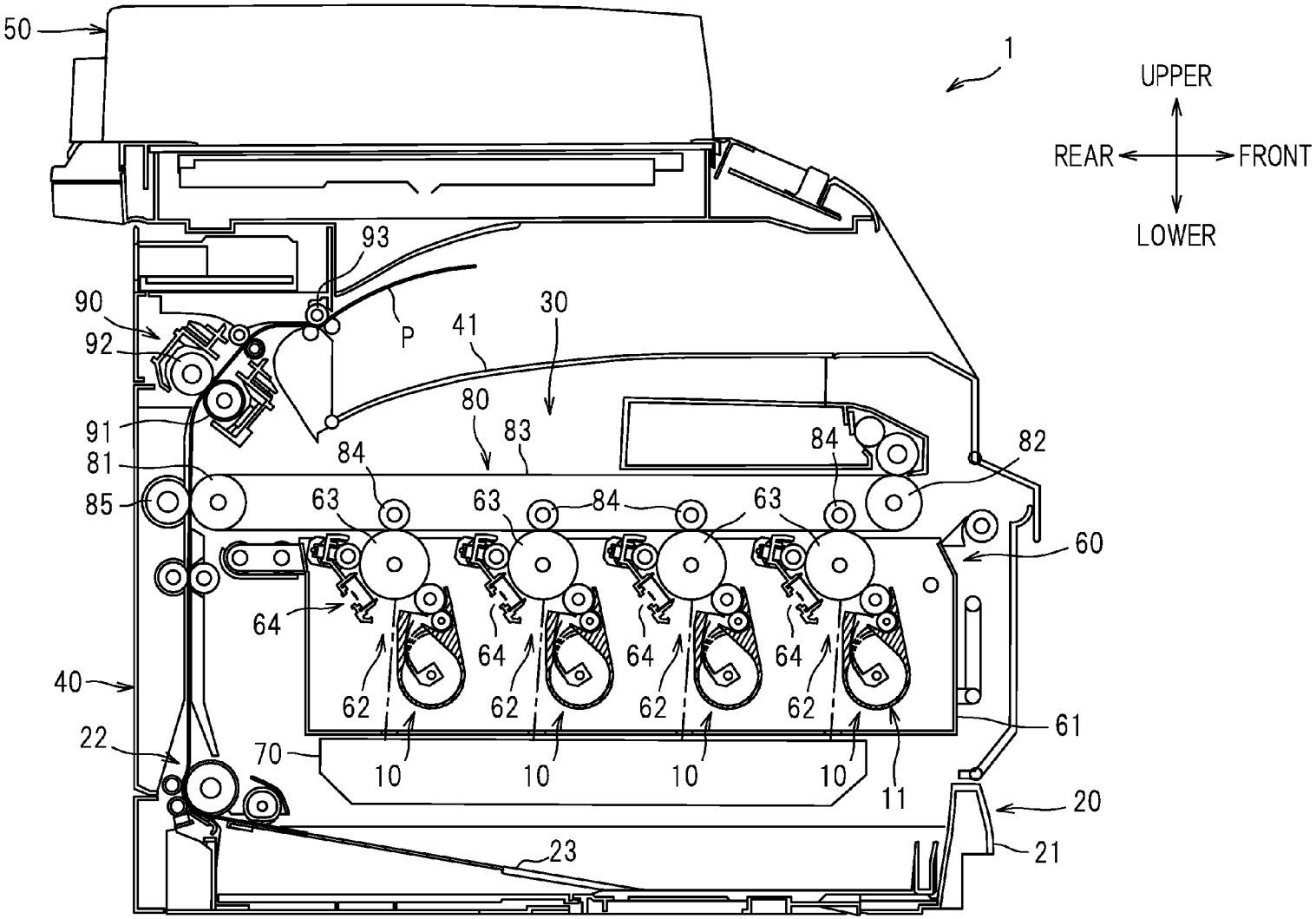
FIG. 1 is a side sectional view showing a schematic representation of a laser printer as an example of an image forming apparatus which includes a developer container according to an embodiment.

A detailed description will be given of an illustrative embodiment of the present invention with reference to the drawings. A developer container according to an illustrative embodiment is included in a development device for an image forming apparatus, and embodied as a main constituent part of a development cartridge (development device) 10 which is detachably installable in a laser printer (image forming apparatus) 1 shown in FIG. 1. In the following description, the left-hand side, right-hand side and upward-downward direction of the drawing sheet of FIG. 1 is referred to as "rear", "front" and "upward/downward (or upper/lower or top/bottom)".

<General Setup of Laser Printer>

As shown in FIG. 1, the laser printer 1 comprises a body casing 40, and several components housed within the body casing 40 which principally include a sheet feeder unit 20 configured to feed a sheet P (e.g., of paper), an image forming unit 30 configured to form an image on the sheet P, and the like. The laser printer 1 further includes a flatbed scanner 50 which is disposed above the body casing 40 and configured to scan documents to produce image data. The image forming unit 30 includes a process unit 60, an exposure unit 70, a transfer unit 80 and a fixing unit 90.

<Sheet Feeder Unit>

The sheet feeder unit 20 includes a sheet feed tray 21 disposed in a lower space within the body casing 40, a sheet feed mechanism 22 disposed rearward of the sheet feed tray 21, and a sheet pressure plate 23 configured to deliver a sheet P stored in the sheet feed tray 21 to the sheet feed mechanism 22. Sheets P stored in the sheet feed tray 21 are pushed up at their rear sides by the sheet pressure plate 23, and one sheet P is separated from the others and conveyed upwardly by the sheet feed mechanism 22.

<Process Unit>

The process unit 60 includes four process cartridges 62 which are accommodated in a holding case 61 and arranged in the front-rear direction at predetermined intervals. Each process cartridge 62 includes a photoconductor drum 63 having a photoconductive layer which forms a peripheral surface thereof, a charger configured to uniformly charge the photoconductive layer of the photoconductor drum 63, and a development cartridge 10 configured to supply developer to the photoconductive layer of the photoconductor drum 63. The photoconductor drum 63 is disposed in an upper part of the process cartridge 62. The charger 64 is disposed rearward of the photoconductor drum 63. The development cartridge 10 is disposed under the photoconductor drum 63.

In each process cartridge 62, the photoconductive layer forming the peripheral surface of the photoconductor drum 63 is uniformly charged by the charger 64, and then exposed to a rapidly sweeping laser beam emitted from the exposure unit 70. By this exposure of the photoconductive layer to the laser beam, an electrostatic latent image formulated based upon image data is formed on the peripheral surface of the photoconductor drum 63. Toner as an example of developer is supplied from the development cartridge 10 to the electrostatic latent image, so that the electrostatic latent image is visualized and a toner image is formed on the peripheral surface of the photoconductor drum 63.

<Exposure Unit>

The exposure unit 70 is disposed above the sheet feeder unit 20 and under the process unit 60. The exposure unit 70 includes various components, though not illustrated, such as a laser light source, a polygon mirror, lenses and reflecting minors. The exposure unit 70 is configured to cause a laser beam emitted from the laser light source to be reflected off the polygon mirror and reflecting mirrors so that the peripheral surface of the photoconductor drum 63 is illuminated and rapidly scanned with the laser beam whereby the peripheral surface of the photoconductor drum 63 is exposed to the laser beam.

<Transfer Unit>

The transfer unit 80 is disposed above the process unit 60. The transfer unit 80 includes a driving roller 81 disposed above the sheet feed mechanism 22 in a rear space within the body casing 40, a driven roller 82 disposed in a front space within the body casing 40, and an intermediate transfer belt 83 looped around the driving roller 81 and the driven roller 82.

The transfer unit 80 further includes four primary transfer rollers 84 and one secondary transfer roller 85. The primary transfer rollers 84 are disposed on an inside of the lower path of the intermediate transfer belt 83 and each positioned opposite to a corresponding photoconductor drum 63 so that the intermediate transfer belt 83 is pressed against the four photoconductor drums 63 of the four process cartridges 62. The secondary transfer roller 85 is disposed opposite to the driving roller 81 so that a sheet P is pressed against the intermediate transfer belt 83.

In the transfer unit 80, each color toner image formed on the peripheral surface (of the photoconductive layer) of each of the four photoconductor drums 63 is transferred consecutively one on top of another onto the intermediate transfer belt 83. A sheet P conveyed from the sheet feed mechanism 22 upward is pressed against the intermediate transfer belt 83 by the secondary transfer roller 85, so that color toner images superposed on the intermediate transfer belt 83 are transferred onto the sheet P.

<Fixing Unit>

The fixing unit 90 is disposed above the driving roller 81 of the transfer unit 80. The fixing unit 90 includes a heating roller 91 configured to heat a sheet P which has been pressed and conveyed upward by the secondary transfer roller 85 into the fixing unit 90, and a pressure roller 92 disposed opposite to the heating roller 91 so as to press the sheet P against the heating roller 91. In this fixing unit 90, color toner images transferred from the intermediate transfer belt 83 onto a sheet P are heated by the heating roller 91 and thermally fixed on the sheet P. The sheet P on which the color toner images are thermally fixed is ejected out by a sheet output roller 93 onto a sheet output tray 41.

<Development Cartridge>

Figure 2:
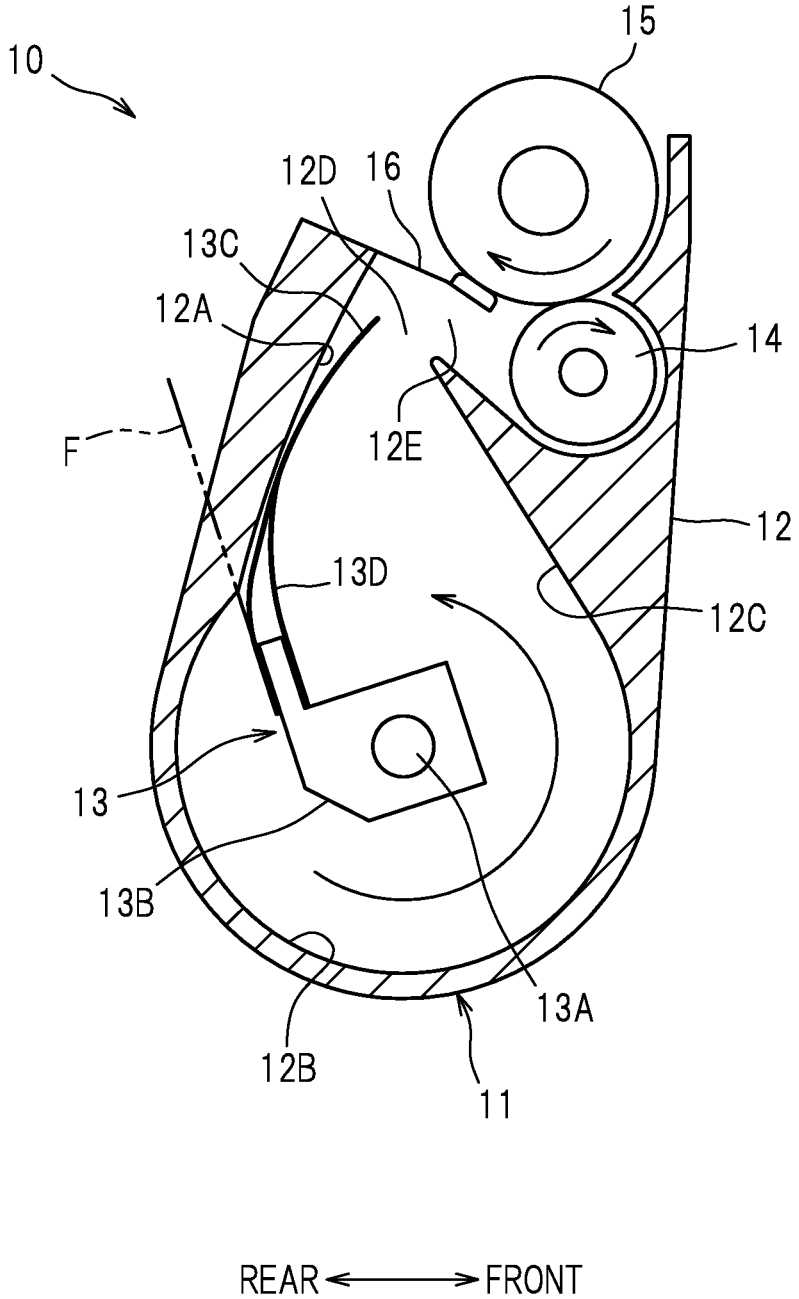
FIG. 2 is a cross-sectional view, taken along a plane perpendicular to an axial direction, of a development cartridge including a developer container shown in FIG. 1.

As shown in FIG. 2 (enlarged view), the development cartridge 10 includes a developer container 11 which comprises a container main body 12 (as an example of a housing) and an agitator 13 (an example of a developer conveying member). The container main body 12 is configured to store toner (not shown). The agitator 13 is disposed in a lower space inside the container main body 12.

The development cartridge 10 further comprises a supply roller 14, a development roller 15, and a doctor blade 16 all of which are arranged in an upper part of the development cartridge 10 (i.e., above the container main body 12).

<Developer Container>

The container main body 12 has a shape elongated in the left-right direction with a cross section shaped like a raindrop having a round bottom and a tapered top which is truncated to form an opening. An inner wall of the container main body 12 is configured to provide a collision part 12A at an upper portion of a rear side (left side in FIG. 2) thereof, a slide flat part 12C at an upper portion of a front side (right side in FIG. 2) thereof, and a slide curve part 12B continuously joining the collision part 12A and the slide flat part 12C at a bottom thereof. A developer conveyance chamber 12D is formed in an upper space between the slide flat part 12C and the collision part 12A, and a developer outlet 12E is provided at the top of the developer conveyance chamber 12D.

The collision part 12A of the container main body 12 is a wall surface with which an agitator main body 13C of the agitator 13, which will be described later, is caused to collide head-on repeatedly while it is being turned around. The collision part 12A is formed along an inclined plane tilted at a predetermined angle toward upstream (backward) in a direction of the revolving motion of the agitator main body 13C with respect to a hypothetical free plane F of the agitator main body 13C that is in the position of the agitator main body 13C assumed to be if the agitator main body 13C returned to its free state (original shape) by its resilient property when the rotary base member 13B is in an angular position to which the rotary base member 13B comes upon collision of the agitator main body 13C with the collision part 12A.

The slide curve part 12B of the container main body 12 is a curved wall surface along which the agitator main body 13C pressed thereon and elastically curved toward upstream (backward) in the direction of the revolving motion of the agitator main body 13C is caused to slide while the agitator main body 13C is being turned around.

The slide flat part 12C of the container main body 12 is a flat wall surface along which the free end portion pressed thereon of the agitator main body 13C elastically curved toward upstream (backward) in the direction of the revolving motion of the agitator main body 13C is caused to slide while the agitator main body 13C is being turned around. This slide flat part 12C is tilted with its upper side being closer to the collision part 12A than its lower side.

The developer conveyance chamber 12D of the container main body 12 is a space in which the agitator main body 13C elastically curved toward upstream (backward) in the direction of the revolving motion thereof is restored to its free state (original shape) by its resilient property while being revolved toward the collision part 12A. To be more specific, the developer conveyance chamber 12D is defined in an upper space from a lower edge of the developer outlet 12E (upper edge of the slide flat part 12C) above.

The developer outlet 12E is an outlet through which toner is fed out from the developer conveyance chamber 12D to the supply roller 14. The developer outlet 12E opens out in a region from the slide flat part 12C above to an inside of the collision part 12A facing upstream in the direction of the revolving motion of the agitator main body 13C.

<Agitator>

The agitator 13 is a part configured to rotate in such a manner that toner (not shown) stored in the container main body 12 is agitated and conveyed to the developer outlet 12E. The agitator 13 includes a rotary shaft 13A extending along the longitudinal direction of the container main body 12 elongated in the left-right direction, the aforementioned rotary base member 13B configured to rotate together with the rotary shaft 13A, the aforementioned agitator main body 13C, and an urging member 13D. The agitator main body 13C and the urging member 13D have base end portions fixed to the rotary base member 13B, respectively.

Figure 3:
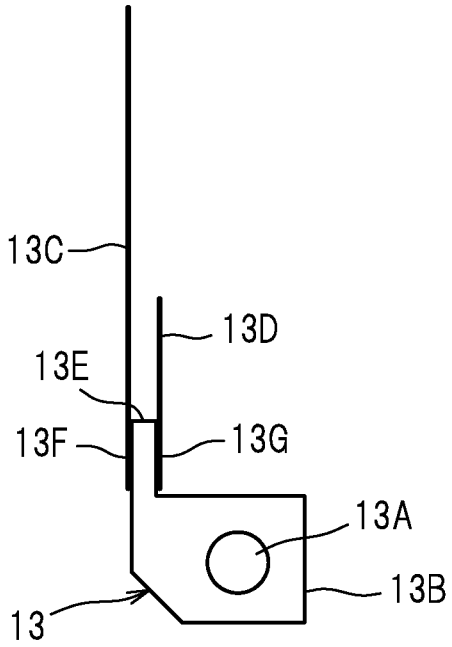
FIG. 3 is a side view of an agitator provided in the developer container shown in FIG. 2.

As shown in FIG. 3, the rotary base member 13B includes a mount piece 13E to which the base end portion of the agitator main body 13C and the base end portion of the urging member 13D located opposite to and separate from each other with a predetermined spacing allowed therebetween are fixed. A left side (in FIG. 3) of the mount piece 13E that is a backside surface facing downstream in the direction of rotation of the rotary base member 13B forms a first surface 13F to which the base end portion of the agitator main body 13C is fixed. A right side (in FIG. 3) of the mount piece 13E that is a foreside surface facing upstream in the direction of the rotation of the rotary base member 13B forms a second surface 13G to which base end portion of the urging member 13D is fixed. The first surface 13F and the second surface 13G are parallel to each other.

The agitator main body 13C is an example of a main body of the developer conveying member. The agitator main body 13C includes a thin sheet-like elastic piece having an elastic (resilient) property, which is made of an appropriate synthetic resin material such as polyethylene terephtalate (abbreviated as PET), for example. The base end portion of the agitator main body 13C is fixed to the first surface 13F of the rotary base member 13B using a double-faced adhesive tape or the like. The length of the agitator main body 13C from its base end to its free end is set to be so long as its free end portion reaches an upper region of the collision part 12A opposite to the developer outlet 12E as shown in FIG. 2.

The urging member 13D is, like the agitator main body 13C, composed of a thin sheet-like elastic piece having an elastic (resilient) property, which is made of an appropriate synthetic resin material such as PET, for example. The base end portion of the urging member 13D is fixed to the second surface 13G using a double-faced adhesive tape or the like. The length of a portion of the urging member protruding from the second surface 13G is set, for example, to be to approximately in a range from one fourth to half of the length of a portion of the agitator main body 13C protruding from the first surface 13F.

As shown in FIG. 2, the supply roller 14 and the development roller 15 with their peripheral surfaces located in close proximity to each other are arranged near the developer outlet 12E on top of the container main body 12. The supply roller 14 is a roller configured to supply toner carried on its own peripheral surface to the peripheral surface of the development roller 15, and disposed below the development roller 15.

The supply roller 14 and the development roller 15 in this embodiment are both configured to rotate clockwise as shown in FIG. 2. The opposed peripheral surfaces of these rollers 14, 15 thus move in directions reverse to each other; i.e., the peripheral surface of the supply roller 14 moves frontward (to the right in FIG. 2), while the peripheral surface of the development roller 15 moves rearward (to the left in FIG. 2). This configuration with reversely moving opposed peripheral surfaces of the rollers 14, 15 may assist in readily realizing a smooth supply of toner from the peripheral surface of the supply roller 14 to the peripheral surface of the development roller 15.

The development roller 15 is a roller configured to carry, on a peripheral surface thereof, toner supplied from the supply roller 14, and to supply the toner to an electrostatic latent image formed on the peripheral surface of the photoconductor drum 63 (see FIG. 1). The development roller 15 is disposed at a front lower side of the photoconductor drum 63.

The doctor blade 16 is a member configured to restrict a thickness of a toner layer supplied from the peripheral surface of the supply roller 14 to the peripheral surface of the development roller 15 and carried thereon to a constant thickness. The doctor blade 16 has a base end portion fixed to an upper end of a rear-side (left-side) portion of the container main body 12 (the rear-side portion of the container main body 12 is a portion on which the collision part 12A is formed), and a free end portion which is provided at an end opposite to a base end at which the base end portion is provided. The doctor blade 16 protrudes from its base end portion frontward (rightward), and the protruded free end portion is in contact with a lower side (which moves rearward (leftward)) of the peripheral surface of the development roller 15 which rotates clockwise as shown in FIG. 2. The free end portion of the doctor blade 16 in contact with the peripheral surface of the development roller 15 thus produces friction as resisting the rotation of the development roller 15.

In the developer container 11 according to the present embodiment configured as described above, as shown in FIG. 4, the rotary base member 13B of the agitator 13 rotates together with the rotary shaft 13A counterclockwise as indicated by an arrow in the container main body 12, and the agitator main body 13C composed of an elastic piece makes a revolving motion about the rotary shaft 13A counterclockwise (in the direction indicated by the arrow), so that toner stored in the container main body 12 is agitated.

Figure 4:
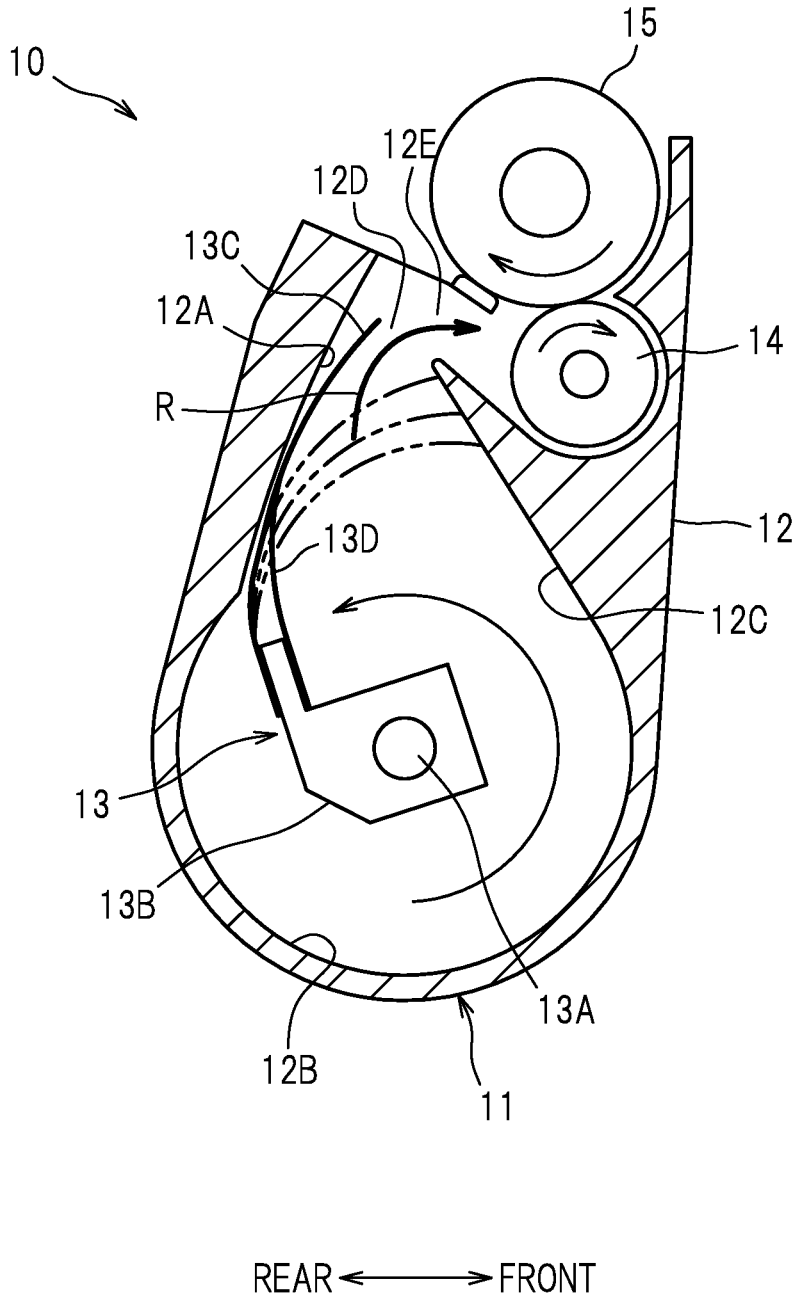
FIG. 4 is a cross-sectional view of the development cartridge shown in FIG. 2, illustrated to show an operation associated with revolution of an agitator main body of the agitator shown in FIGS. 2 and 3.

The agitator main body 13C caused to revolve counterclockwise in the direction indicated by the arrow in FIG. 4 remains elastically curved toward upstream (backward) in the direction of the revolving motion thereof while the free end portion thereof revolves and slides along the slide curve part 12B and the slide flat part 12C of the container main body 12. This agitator main body 13C restores its free state (original flat shape) by its own resilient force (elastic property) while turning around inside the developer conveyance chamber 12D so as to force toner into the developer conveyance chamber 12D, and further moves around to collide with the collision part 12A. This operation produces a conveying current of air R, which entrains toner so that the toner is conveyed toward the developer outlet 12E.

In this operation, the thin sheet-like agitator main body 13C made of a synthetic resin material such as PET is urged from an upstream side toward a downstream side in the direction of revolution thereof with its middle portion pressed by the urging member 13D made of a similar synthetic resin material. Therefore, when the agitator main body 13C restores its free state by its elastic property, the agitator main body 13C increases its revolving speed by the increased resilient force, so that the ability of conveying toner is enhanced. Moreover, the deterioration of the elastic property of the agitator main body 13C is reduced so that the durability of the agitator 13 can be improved.

Accordingly, with the developer container 11 configured in accordance with the present embodiment, the resilient force of the agitator main body 13C can be increased so that the toner conveying ability of the agitator 13 can be improved. Furthermore, the deterioration of the elastic property of the agitator main body 13C can be prevented so that the durability of the agitator 13 can be improved.

Since the base end portions of the agitator main body 13C and the urging member 13D are separate from each other, the free end portion of the urging member 13D can effectively urge the agitator main body 13C from the upstream side toward the downstream side in the direction of revolution of the agitator main body 13C. Furthermore, since the length from the base end to the free end of the urging member 13D is shorter than the length from the base end to the free end of the agitator main body 13C, the middle portion of the agitator main body 13C is urged by free end portion of the urging member 13D, so that the agitator main body 13C can be urged more effectively from the upstream side toward the downstream side in the direction of revolution of the agitator main body 13C.

Although an illustrative embodiment of the present invention has been described above, the present invention is not limited to the above-described embodiment. Various modifications and changes may be made to the specific structures and arrangement without departing from the scope of the present invention.

Figure 5:
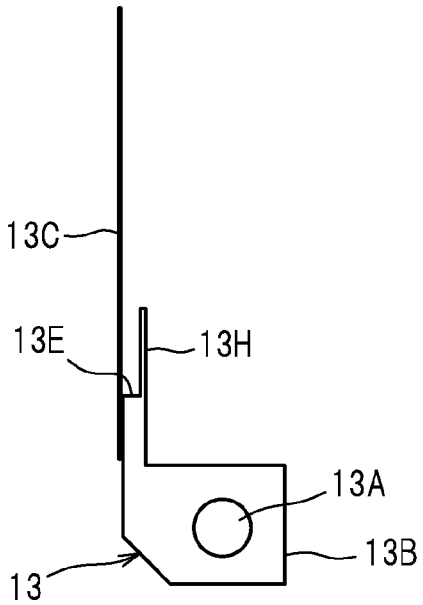
FIG. 5 is a side view of an agitator according to a first variation of the embodiment of FIG. 3.

For example, the urging member 13D of the agitator 13 as shown in FIG. 3 may be modified as shown in FIG. 5 where the agitator 13 comprises an urging member 13H formed integrally with the mount piece 13E of the rotary base member 13B. In this modified embodiment, the rotary base member 13B may be of an appropriate synthetic resin material such that the urging member 13H serves as a leaf spring having a great spring constant (a great modulus of elasticity), whereby the toner conveying ability of the agitator 13 can be further improved and the durability of the agitator 13 can be further improved.

Figure 6:
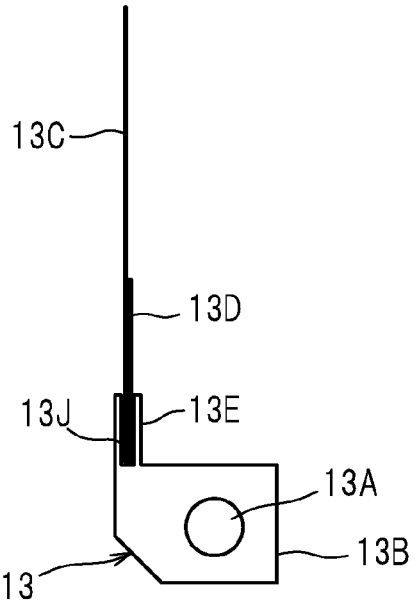
FIG. 6 is a side view of an agitator according to a second variation of the embodiment of FIG. 3.

The agitator main body 13C and the urging member 13D of the agitator 13 as shown in FIG. 3 may be modified as shown in FIG. 6 where the mount piece 13E of the rotary base member 13B provided in the agitator 13 has an attachment groove 13J in which the base end portions of the agitator main body 13C and the urging member 13D are fitted with an adhesive or the like being applied for fixing the base end portions to the mount piece 13E.

The urging member 13D of the agitators 13 as shown in FIGS. 3 and 6 may be made of a synthetic resin material having a high creep resistance so that the toner conveying ability of the agitator 13 can be further increased and the durability of the agitator 13 can be further improved. Furthermore, the urging member 13D may be of a material more creep-resistant than that of the agitator main body 13C. To be more specific, only the urging member 13D of which the length from the base end to the free end is shorter than that of the agitator main body 13C which is made of a synthetic resin material such as PET may be made of a synthetic resin material more creep-resistant than that of the agitator main body 13C. Accordingly, increase in the cost of materials can be suppressed.

Figure 7:
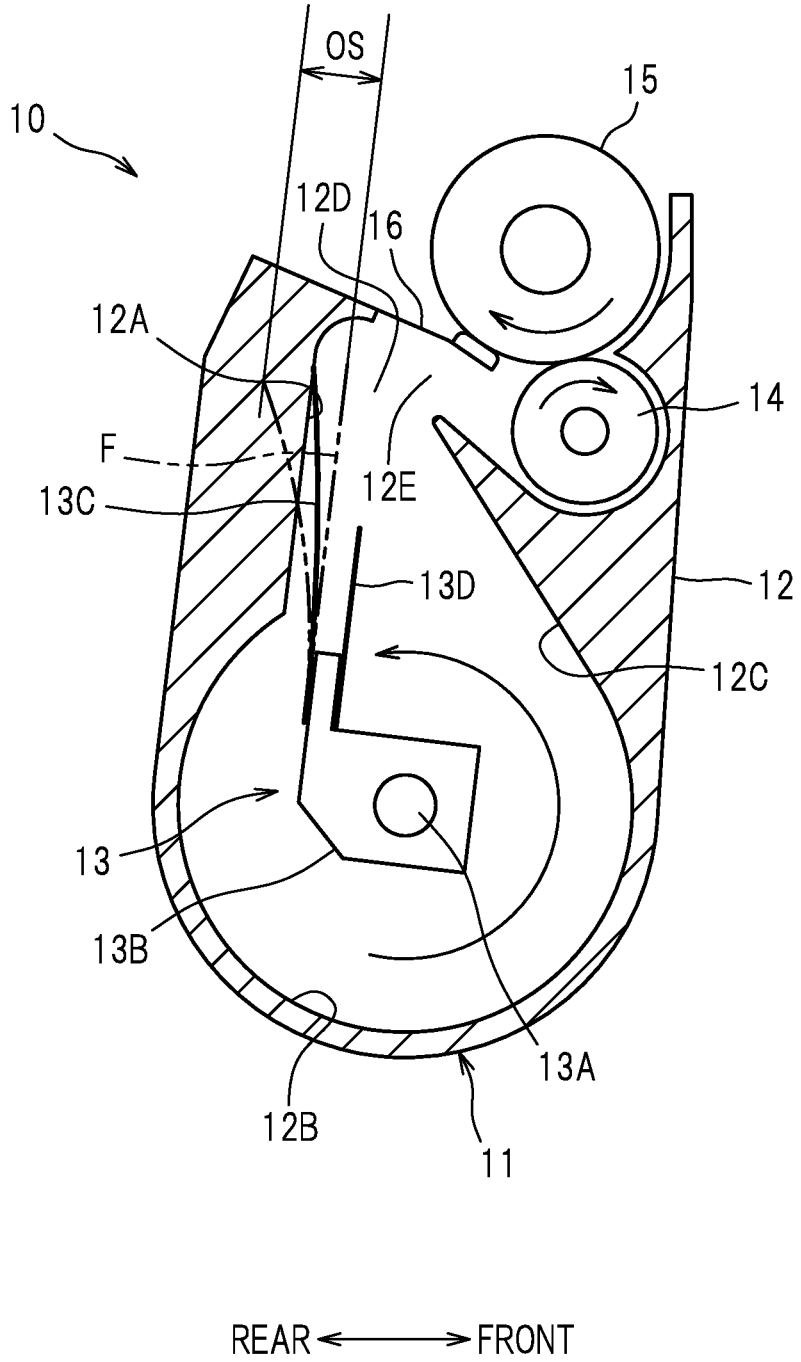
FIG. 7 is a cross-sectional view of a development cartridge which includes a developer container that is similar to that shown in FIG. 2, but modified therefrom according to a modified embodiment.

As shown in FIG. 7, the collision part 12A of the container main body 12 may be disposed in parallel with and spaced a predetermined distance apart from a hypothetic free plane F in which the agitator main body 13D in a free state would be located when the rotary base member 13B is in an angular position at which the agitator main body 13C is assumed to collide with the collision part 12A. It is to be understood that the predetermined distance between the hypothetic free plane F and the collision part 12A may preferably be smaller than an overshoot OS (amount of excessive distance from the hypothetic free plane F) of the agitator main body 13C that would reach, if the collision part 12A were not present, when the rotary base member 13B is in the angular position at which the agitator main body 13C in the free state is in the hypothetic free plane F, because the agitator main body 13C is caused to collide with the collision part 12A without fail.

Figure 8:
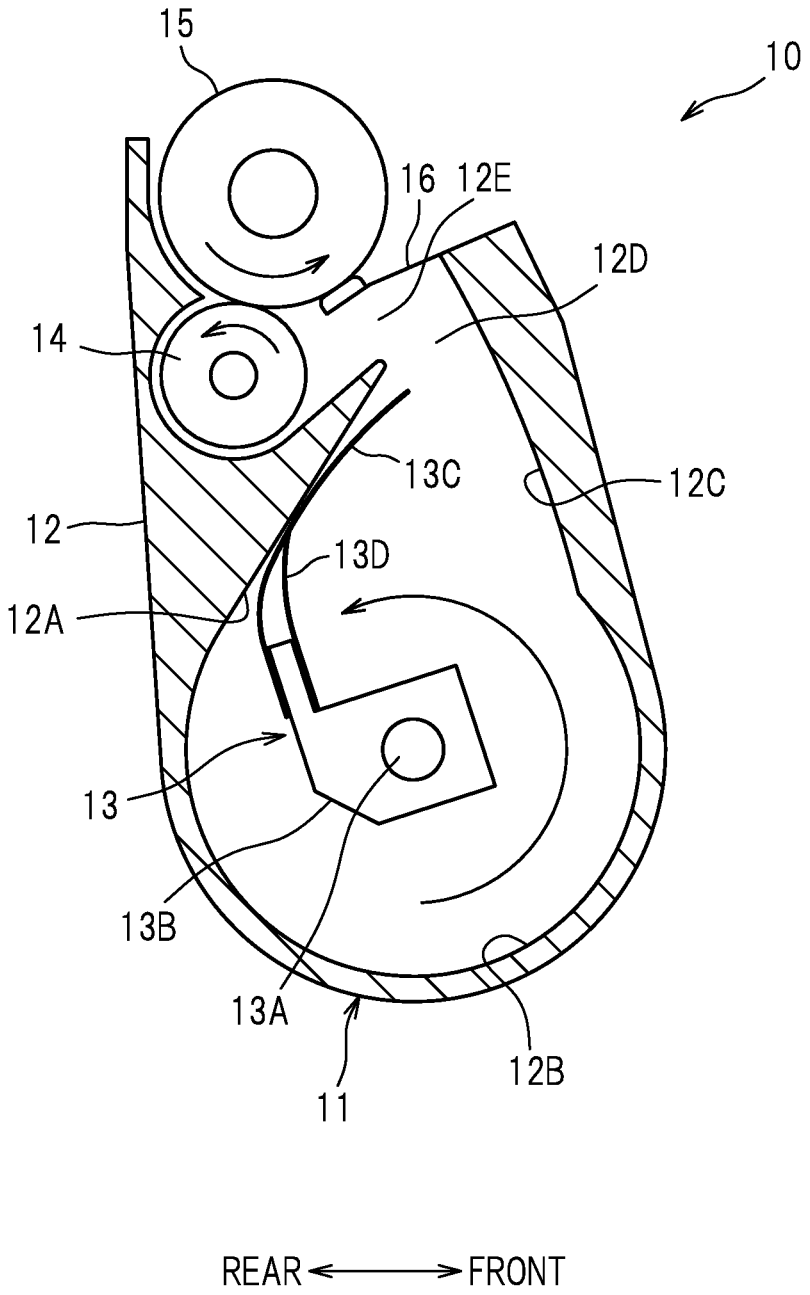
FIG. 8 is a cross-sectional view of a development cartridge which includes a developer container that is similar to that shown in FIG. 2, but modified therefrom in arrangement of a supply roller and a development roller according to another modified embodiment.

Arrangement of the supply roller 14, the development roller 15 and the doctor blade 16 as shown in FIG. 2 may be modified as shown in FIG. 8 where these members 14, 15, 16 are in positions bilaterally symmetrical with those of the corresponding members 14, 15, 16 in FIG. 2. To be more specific, a development chamber in which the development roller 15 is disposed may be provided in a position downstream in the direction of revolution of the agitator main body 13C relative to the collision part 12A. In this alternative embodiment, the development roller 15 and the supply roller 14 may be configured to rotate counterclockwise reverse to the direction shown in FIG. 2.

Furthermore, the rotary shaft 13A of the agitator 13 as shown in FIG. 2 may be arranged in an eccentric position that deviates from the center of curvature of the slide curve part 12B, for example, in an eccentric position closer to the slide flat part 12C. With this configuration, as the agitator main body 13C is pressed against the slide curve part 12B and thus elastically curved and slid along the slide curve part 12B, the curvature of the agitator main body 13C gradually increases, and the resilient force for the agitator main body 13C to restore its original shape while sliding along the slide flat part 12C increases accordingly, with the result that the amount of toner conveyed by the agitator main body 13C increases.

Although the developer container 11 according to the present embodiment is configured as a tall container in which toner is conveyed upward by the agitator 13, a developer container consistent with the present invention may be configured as a low-profile container in which toner is conveyed in a front-rear direction by an agitator.

The developer container may be configured in accordance with the present invention as a toner cartridge provided separately from the supply roller 14, the development roller 15 and the doctor blade 16.

According one or more of the embodiments of the present invention, the resilient force of the main body (agitator main body 13C) can be increased, whereby the toner conveying ability of the developer conveying member (agitator 13) can be increased. Moreover, the decrease in the resilient force of the main body of the developer conveying member can be compensated with the urging member, and the durability of the developer conveying member can be improved.

What is claimed is:

1. A developer container for an image forming apparatus, comprising:

a housing configured to store developer; and a developer conveying member disposed inside the housing and configured to rotate to convey the developer stored in the housing, the developer conveying member comprising a rotary shaft, a rotary base member configured to rotate together with the rotary shaft, and a sheet-like main body fixed to the rotary base member and configured to revolve about the rotary shaft, wherein the main body has a base end portion fixed to the rotary base member and a free end portion configured to be pressed into contact with an inner wall of the housing, wherein the rotary base member comprises an urging member configured to urge the main body from an upstream side toward a downstream side in a direction of rotation thereof, wherein the main body and the urging member are configured such that, when the free end of the main body contacts an inner surface of the housing and the main body is deformed, the urging member comes into contact with an upstream-facing surface of the main body, and when the free end of the main body separates from the inner surface of the housing, the main body separates from the urging member, and wherein a length from a base end to a free end of the urging member is shorter than a length from a base end to a free end of the main body.

2. The developer container according to claim 1, wherein the urging member includes a sheet-like elastic piece having a base end portion fixed to the rotary base member and a free end portion configured to urge the main body, and the base end portion of the main body and the base end portion of the urging member are separate from each other.

3. The developer container according to claim 2, wherein the rotary base member and the urging member are formed integrally in a single-piece construction.

4. The developer container according to claim 2, wherein the rotary base member has a first surface to which the base end portion of the main body is fixed, and a second surface to which the base end portion of the urging member is fixed, the first surface and the second surface being parallel to each other.

5. The developer container according to claim 1, wherein the rotary base member and the urging member are formed integrally in a single-piece construction.

6. The developer container according to claim 1, wherein the urging member includes a sheet-like elastic piece having a base end portion fixed to the rotary base member and a free end portion configured to urge the main body, and the base end portion of the main body and the base end portion of the urging member are attached to each other.

7. The developer container according to claim 1, wherein the urging member includes a sheet-like elastic piece having a base end portion fixed to the rotary base member and a free end portion configured to urge the main body, and the urging member is of a material more creep-resistant than that of the main body.

* * * * *